United States Patent [19]

Stamp, Jr. et al.

[11] 4,328,680

[45] May 11, 1982

[54] HEAT PUMP DEFROST CONTROL APPARATUS

[75] Inventors: Custis L. Stamp, Jr., Tyler, Tex.; Rollie R. Herzog, Louisville, Ky.

[73] Assignee: General Electric Company, Louisville, Ky.

[21] Appl. No.: 196,411

[22] Filed: Oct. 14, 1980

[51] Int. Cl.[3] ..... F25D 21/06

[52] U.S. Cl. ..... 62/155; 62/156; 62/234

[58] Field of Search ..... 62/155, 156, 234

[56] References Cited

U.S. PATENT DOCUMENTS

| | | | |
|---|---|---|---|
| 4,123,915 | 11/1978 | Stoor | 62/234 |
| 4,156,350 | 5/1979 | Elliott et al. | 62/80 |
| 4,209,994 | 7/1980 | Mueller et al. | 62/156 |

*Primary Examiner*—Albert J. Makay
*Assistant Examiner*—Harry B. Tanner
*Attorney, Agent, or Firm*—Frank P. Giacalone; Radford M. Reams

[57] ABSTRACT

A heat pump having successive defrosting operations initiated, controlled and timed by a microprocessor-based controller. The time intervals between defrost cycles are periodically varied as needed, dependent on outdoor temperature and certain operating conditions of the heat pump system. Initially the microprocessor is programmed to select and establish a minimum outdoor temperature-related defrost lockout time interval which may then be automatically extended during the lockout period by amounts of time during which, simultaneously, the outdoor coil is above a predetermined coil temperature level and the heat pump compressor is not running. The minimum defrost lockout interval is periodically revised and established, within certain limits, at a value which is dependent on outdoor temperature. An optional feature allows different time vs. temperature lockout time interval functions to be established for different geographical areas having marked differences in average cold weather climatic conditions.

9 Claims, 7 Drawing Figures

DEFROST LOCKOUT TIME (MINUTES)
300
280
260
240
220
200
180
160
140
120
100
80
60
40
20
0
88
86
84
90 MIN.
60 MIN.
30 MIN.
2°F
10°F
20°F
OUTDOOR AMBIENT TEMPERATURE ($T_8$)

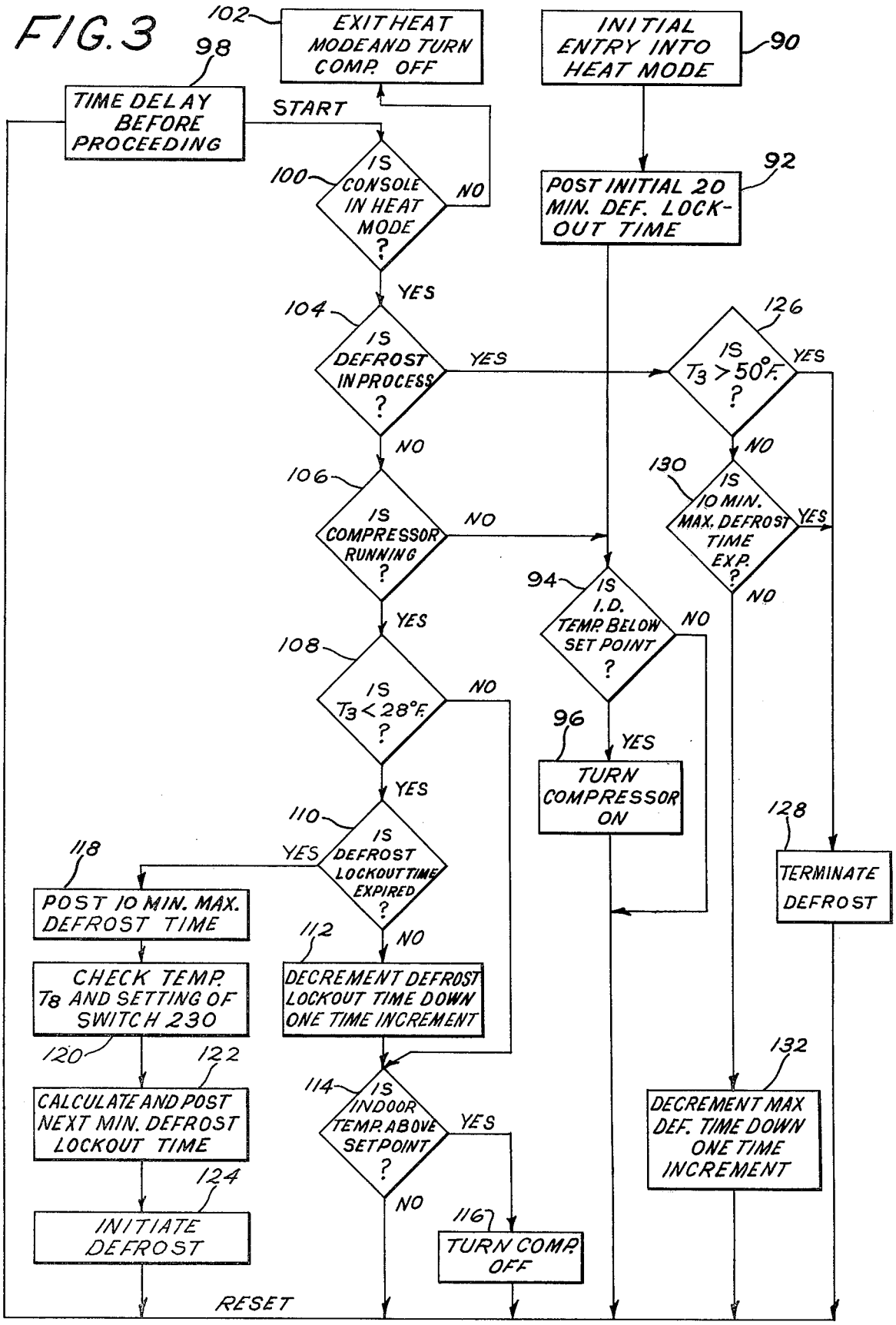
FIG. 3
102
EXIT HEAT MODE AND TURN COMP. OFF
INITIAL ENTRY INTO HEAT MODE
90
98
TIME DELAY BEFORE PROCEEDING
START
100
IS CONSOLE IN HEAT MODE ?
NO
YES
POST INITIAL 20 MIN. DEF. LOCK-OUT TIME
92
104
IS DEFROST IN PROCESS ?
YES
126
IS T3 > 50°F. ?
YES
NO
NO
106
IS COMPRESSOR RUNNING ?
NO
130
IS 10 MIN. MAX. DEFROST TIME EXP. ?
YES
NO
94
IS I.D. TEMP. BELOW SET POINT ?
NO
YES
108
IS T3 < 28°F. ?
NO
YES
96
TURN COMPRESSOR ON
YES
110
IS DEFROST LOCKOUT TIME EXPIRED ?
YES
NO
128
TERMINATE DEFROST
118
POST 10 MIN. MAX. DEFROST TIME
112
DECREMENT DEFROST LOCKOUT TIME DOWN ONE TIME INCREMENT
CHECK TEMP. T8 AND SETTING OF SWITCH 230
120
122
CALCULATE AND POST NEXT MIN. DEFROST LOCKOUT TIME
114
IS INDOOR TEMP. ABOVE SETPOINT ?
YES
NO
132
DECREMENT MAX DEF. TIME DOWN ONE TIME INCREMENT
124
INITIATE DEFROST
116
TURN COMP. OFF
RESET (A) → DEFROST INHIBIT TIME INTERVAL (LOCKOUT)

(B) → DEFROST CYCLE (C) → EXTENSION OF DEFROST LOCKOUT TIME

HEAT PUMP DEFROST CONTROL APPARATUS

CROSS REFERENCE TO RELATED APPLICATIONS

This application is related to concurrently filed application Ser. Nos. 196,412, 196,413, 196,414, and 196,425, each filed jointly in the names of Custis L. Stamp, Jr. and Rollie R. Herzog, and each assigned to General Electric Company, the assignee of the present invention.

BACKGROUND OF THE INVENTION

This invention relates generally to heat pumps having reversible vapor compression refrigerant systems and more specifically to automatic control of the defrost operation of the refrigerant system whereby successive defrost cycle operations are spaced apart variably in time as a function of the outdoor climate conditions to which the outdoor coil of the heat pump is exposed.

As is well known, frost build-up occurs on the outdoor coil of heat pump refrigerant systems when operating in the heating mode and it is necessary to periodically reverse the refrigerant flow in the system to heat the coil and thereby remove the frost.

Typically, heat pumps known in the prior art are caused to enter into the defrost cycle at regular fixed intervals of time. A preselected clocked time interval is provided which is established largely as the result of experience with heat pump operation in average winter climate conditions encountered in the field. The difficulty with this is that under extreme conditions of rapid frost build-up, the heat pump operates at reduced heating efficiency during heavy frost conditions on the outdoor coil before the system enters into defrost. Conversely, during very mild frost build-up conditions, the system is often caused to enter defrost operation prematurely since insufficient frost has formed to adversely affect the heating efficiency of the heat pump. In this case, however, even though the heat pump efficiency remains unchanged, the overall system efficiency is adversely affected. Defrost operation is the same as the cooling operating mode for the heat pump and it is, therefore, necessary to employ auxiliary heat sources, such as electrical strip heaters, to counteract the cooling effect that is imposed on the room space during the defrost cycle. It is this added use of power for heating during unnecessary defrost cycles that reduces the overall heating system operating efficiency from what would be possible with fewer defrost cycles, i.e. providing longer time intervals between defrost cycles under light frost build-up conditions. It is, therefore, desirable to provide means for altering the intervals between which the defrost cycle is initiated as a function of actual climate conditions in order to optimize the overall operating efficiency of the heating system of which the heat pump is a part.

It is, therefore, an object of the invention to provide a heat pump with automatic defrost control means adapted for adjusting the time between successive defrost operations as a function of the outdoor climate conditions to which the outdoor coil of the heat pump is exposed.

It is a further object of the invention to provide automatic defrost control for a heat pump that varies the time interval between defrost cycles as a function of variations in outdoor ambient temperature.

It is yet another object of the invention to provide a heat pump with defrost control means which permits alternative defrost cycle time vs. temperature functions to be employed, such functions having provision for relating the temperature to average climate conditions prevalent in respectively different geographical locations in which the heat pump may be installed. The desired function may be selected in accordance with a feature of the invention at the time of manufacture, installation or maintenance of the heat pump.

SUMMARY OF THE INVENTION

Briefly, in accordance with the objects and principles of the invention, there is provided automatic defrost control apparatus in a heat pump having a reversible vapor compression refrigerant system, which system includes a refrigerant compressor, an indoor heat exchanger, an outdoor heat exchanger in thermal communication with outdoor atmosphere, and means for reversing refrigerant flow between the heat exchangers to switch the operation of the heat pump from an indoor heating mode to an outdoor heat exchanger defrost cycle mode. The automatic defrost cycle control apparatus of the invention includes means for sensing the temperature of the outdoor atmosphere, means for establishing a range of temperature-related minimum defrost lockout time intervals during which operation of the defrost cycle is to be inhibited, this range of time intervals extending from a first interval effective at and above a first outdoor temperature to a second, longer interval effective at and below a second temperature level which is lower than the first temperature level. The apparatus of the invention further includes means responsive to at least the temperature sensing means at the conclusion of a defrost lockout time interval to select one of the minimum time intervals to be effective as the next successive minimum defrost lockout time interval. The apparatus further includes means for sensing the temperature of the refrigerant system at a predetermined point on the outdoor heat exchanger and further includes means responsive to the compressor and the refrigerant system temperature sensing means following the conclusion of a defrost cycle for clocking the time interval between defrost cycles only during the simultaneous occurrence of the compressor being in a running mode and the sensed refrigerant system temperature being below a predetermined temperature level. The apparatus finally includes means for initiating a defrost cycle when the clocked time interval is equal to the selected minimum defrost lockout time interval.

These and other objects of the invention will become apparent to those skilled in the art from the following detailed description and attached drawings which, by way of example, illustrate one form of a preferred embodiment of the invention.

BRIEF DESCRIPTION OF THE DRAWINGS

FIG. 3 shows a flow diagram for realization of the defrost function by the system controller of the heat pump of FIG. 1.

DESCRIPTION OF THE PREFERRED EMBODIMENT

Figure 1:
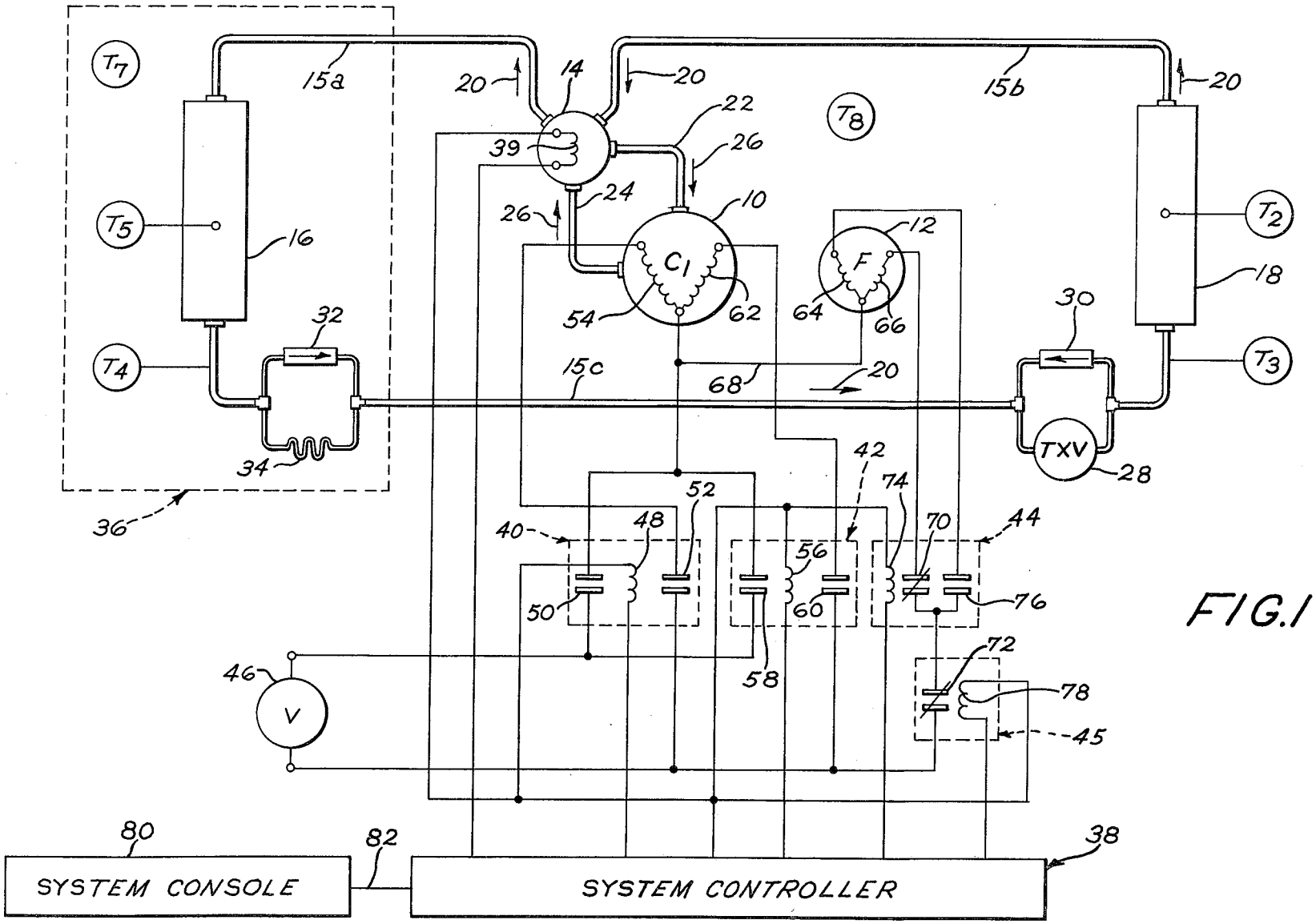
FIG. 1 shows a schematic diagram of a heat pump, including its refrigerant system and related control circuits, thus illustrating one preferred embodiment of the invention.

Referring now to FIG. 1, there is shown, in one preferred embodiment of the invention, a heat pump which includes among its conventional components a two-speed compressor 10 and a two-speed fan 12. A conventional fluid switch-over valve 14 provides means for reversing the direction of flow of a fluid refrigerant through a series of pipe lines 15*a, b* and *c* through an indoor and outdoor heat exchanger coil 16 and 18, respectively, in order to switch the operation of the heat pump from a heating mode to a cooling or defrost cycle mode and vice versa. A series of arrows 20 indicates the direction of refrigerant flow between the valve 14 and coils 16, 18 when the heat pump is operating in the heating mode. The refrigerant flows through the lines 15*a, b* and *c* in the direction opposite that indicated by the arrows 20 when the heat pump is operating in the cooling and defrost cycle modes. However, regardless of whether the heat pump is operating in the heating, cooling or defrost modes, when compressor 10 is running, the fluid refrigerant is always drawn from the valve 14 into a low pressure inlet port of the compressor 10 through a suction line 22 and is always delivered from a high pressure outlet port of the compressor 10 back to the valve 14 through a high pressure line 24, all as indicated by a pair of arrows 26.

When the heat pump is operating in the heating mode, a conventional fluid expansion valve 28 permits the refrigerant to expand rapidly therethrough to cool to its lowest temperature within the closed fluid circuit just prior to entry into the cold end of the outdoor coil 18. A conventional one-way check valve 30 remains closed to the flow of refrigerant therethrough when the heat pump is operating in the heating mode, but freely passes the refrigerant therethrough to by-pass the expansion valve 28 when refrigerant is flowing in the direction opposite the arrows 20, as when the heat pump is operating in the cooling or defrost cycle modes. A second one-way check valve 32 permits the refrigerant to flow freely from the indoor coil 16 into the line 15*c* when the heat pump is operating in the heating mode but remains closed to the flow of refrigerant therethrough when the heat pump is operating in the cooling or defrost cycle modes, thus forcing the refrigerant through a conventional fluid restrictor or capillary tube 34.

A dashed enclosure 36 represents a closed structure to be selectively temperature conditioned, i.e. cooled or heated by the heat pump. Those components of the fluid conductive circuit located within the structure include the indoor coil 16, the valve 32 and the capillary tube 34. As is well known, suitable air moving means, such as a fan and duct work (not shown), may be provided to cause the coil 16 to be in thermal communication with the space in the structure which is to be temperature conditioned. An outdoor fan 12 and the remaining components of the fluid conductive circuit, namely, the compressor 10, valves 14, 28 and 30, and the outdoor coil 18 are located outside of the structure to be temperature conditioned, typically in the outdoor ambient atmosphere.

Now, in accordance with an aspect of the present invention, there is also shown in FIG. 1 a system controller 38 which comprises in part a microprocessor-based preprogrammed micro-computer adapted to, among other things, control the defrosting of the outdoor coil 18. Upon command, the controller 38 supplies a suitable a.c. operating potential across a solenoid coil 39 of the switch-over valve 14 to control the switchable state thereof, and a suitable low voltage a.c. potential to a series of relays 40, 42, 44 and 45 which relays, in turn, supply a suitable high voltage a.c. operating potential from a source 46 to the compressor 10 and fan 12. The source 46 may, for example, be the usual commercially available 240 volt, single phase potential. The controller 38 operates the compressor 10 at high speed by energizing a coil 48 of the high speed compressor relay 40 to close two sets of normally open relay contacts 50 and 52, thus placing the source 46 across a high speed coil 54 of the compressor 10. Similarly, the controller 38 operates the compressor 10 at low speed by de-energizing the relay coil 48 and energizing a relay coil 56 of the low speed compressor/relay 42 to close two sets of normally open contacts 58 and 60, thus placing the source 46 across a low speed coil 62 of the compressor 10.

The fan 12 may also be operated at high or low speed by the controller 38, depending upon whether a high or low fan speed coil 64 or 66 is energized from the source 46 by the fan speed control relay 44. A line 68 connects one end of each of the coils 64 and 66 to one side of the source 46 whenever either of the high or low compressor speed relays 40 or 42 is energized to operate the compressor 10. The other end of the low speed fan coil 66 is connected through a set of normally closed contacts 70 of the relay 44 and a set of normally closed contacts 72 of the defrost relay 45 to the other side of the source 46 so as to operate the fan 12 at low speed when both of the relays 44 and 45 are de-energized. The controller 38 switches the fan 12 to high speed operation by energizing a relay coil 74 of the fan speed control relay 44, thus opening the contacts 70 and closing a set of contacts 76 to switch the source 46 from the coil 66 to the coil 64. In order to enhance the heat build-up in the outdoor coil 18 during defrosting operations, the fan 12 is rendered inoperative by the controller 38, even though the compressor 10 will be running, by energizing a relay coil 78 of the defrost relay 45 to open the contacts 72, thus disconnecting the fan 12 from the source 46.

A system console 80 includes various user-operated control switches, display registers and associated logic circuits for manual entry of control data to the system and is electrically connected to the controller 38 through a conventional cable or wiring harness 82. The console 80 may, therefore, be located near or remote with respect to the controller 38 at any location that may be considered convenient for the manual entry of control data or operating set point information to the heat pump.

As previously noted, operation of the heat pump in the heating mode causes the outdoor heat exchanger coil to accumulate frost which adversely affects the operating efficiency of the system and it is, therefore, customary to provide for periodic defrosting of the coil. An important aspect of the present invention lies in the determination that, from an overall system energy efficiency standpoint, it is highly desirable to cause successive defrost cycles to be initiated at the end of time intervals which may be selectively varied in duration from time to time as a function of the atmospheric conditions to which the outdoor coil is exposed during extended heating modes of operation. More specifically, it is a feature of the present invention that the minimum time interval between defrost cycles, i.e. defrost lockout time, is periodically selected and established in the defrost control program in the microprocessor of system controller 38 to be initially at a minimum time value which is dependent, at least in part, on the ambient outdoor temperature. This minimum lockout time may be established once each defrost cycle or after the occurrence of a number of defrost cycles, with the preferred choice being once each defrost cycle. Additionally, it is another feature of the present invention that the microprocessor of controller 38 is programmed to respond to certain variable conditions occurring during the defrost lockout interval, such as outdoor coil temperature and actual compressor run time, to delay the occurrence of the next succeeding defrost cycle by automatically extending the selected minimum defrost lockout time interval. In this way, the timing of the initiation of the defrost cycle may be tailored automatically to specific atmospheric conditions to avoid either premature initiation of the defrost cycle when it may not be needed or excessive delays between defrost cycles when heavy frost conditions require fairly frequent defrosting.

Referring to the time vs. temperature graph of FIG. 2, it has been determined that when the refrigerant temperature at the coldest point of the outdoor coil 18, the point at which temperature $T_3$ is connected, is below some predetermined temperature, for example 28° F., there is a range of outdoor ambient temperatures which has the greatest effect on the rate of frost build-up on outdoor coil 18. Although the limits of this outdoor temperature range are imprecise, a range of from 2° F. to 20° F. may be considered typical. At the relatively higher temperatures of 20° F. and above, the relative humidity is such as to be conducive to rapid frost build-up. Above the exemplary 20° F. temperature level the rate of frost build-up, although relatively high, tends not to continue to increase significantly due to the fact that the actual quantity of moisture contained in the air does not increase markedly with the rising temperature (keeping in mind that this discussion refers to the cool seasonal temperatures that would result in the heat pump operating in the heating mode). As the temperatures drop below the 20° F. level, the relative humidity conditions that normally occur in this colder air are such as to result in a significant reduction in the frosting conditions on the coil 18. Thus, a temperature level, such as 20° F., can be determined at which the defrosting cycle is desirably initiated at the most frequent repetitive rate corresponding to the shortest minimum defrost lockout time interval. Since, at temperature levels below this 20° F., the rate of frost build-up progressively decreases with decreasing temperature due to the naturally decreasing moisture content in the cooler air, less frequent defrosting is required and longer minimum defrost lockout time intervals can be employed. It is desirable, however, during extended periods of operation in the heating mode to provide for periodic initiation of the defrost cycle at some extended time interval, even though frost build-up would not be sufficient to call for a defrost cycle, in order to provide for periodic reverse flushing of the refrigerant system in the heat pump. Thus, a lower outdoor temperature limit, such as 2° F., may be determined beyond which no further appreciable benefit is achieved by further delaying initiation of a defrost cycle and, in fact, it becomes desirable to enter a defrost cycle for reasons unrelated to actual frost build-up on the outdoor coil 18. Consequently, according to one important aspect of this invention, a range of temperature related minimum defrost lockout time intervals may be established for the purpose of varying the minimum time between defrost cycles as a function of conditions affecting the rate of frost build-up. This range of time intervals, therefore, extends from a first time interval which is effective at or above a temperature level, such as 20° F., progressively increasing to a second, longer time interval effective at or below a second temperature level, such as 2° F., which is lower than the first temperature level.

Since heat pumps are typically permanently installed, it is possible to further tailor this selection of minimum defrost lockout time interval to average climate conditions that are prevalent in various geographical areas. Thus, means may be provided to select, either at the time of manufacture or at the time of installation, from a plurality of temperature related time interval ranges. FIG. 2 illustrates three separate and distinct stepwise time vs. temperature functions 84, 86, 88 which are representative of individually selectable ranges of minimum defrost lockout time intervals that may be employed in control apparatus of the present invention. The coordinate data points for each of the selectable ranges may be stored within a preprogrammed memory in system controller 38 and, as such, are individually selectable by means to be described subsequently for use in the particular geographic area in which the heat pump is installed. Typically, for example, the data points for range function 88 would be selected for areas having fairly low humidity winter climate conditions such as might be found in Colorado or Northern New York State. On the other hand, data points corresponding to range functions 86 or 84 would be selected for areas having winter climates in which higher humidity conditions prevail. An example of the latter in which function 84 would be employed might be along the Ohio River at the Kentucky and Indiana border where temperatures in the range of 10°–40° F., accompanied by high relative humidity, typically occur in the months of November to March.

Figure 6:
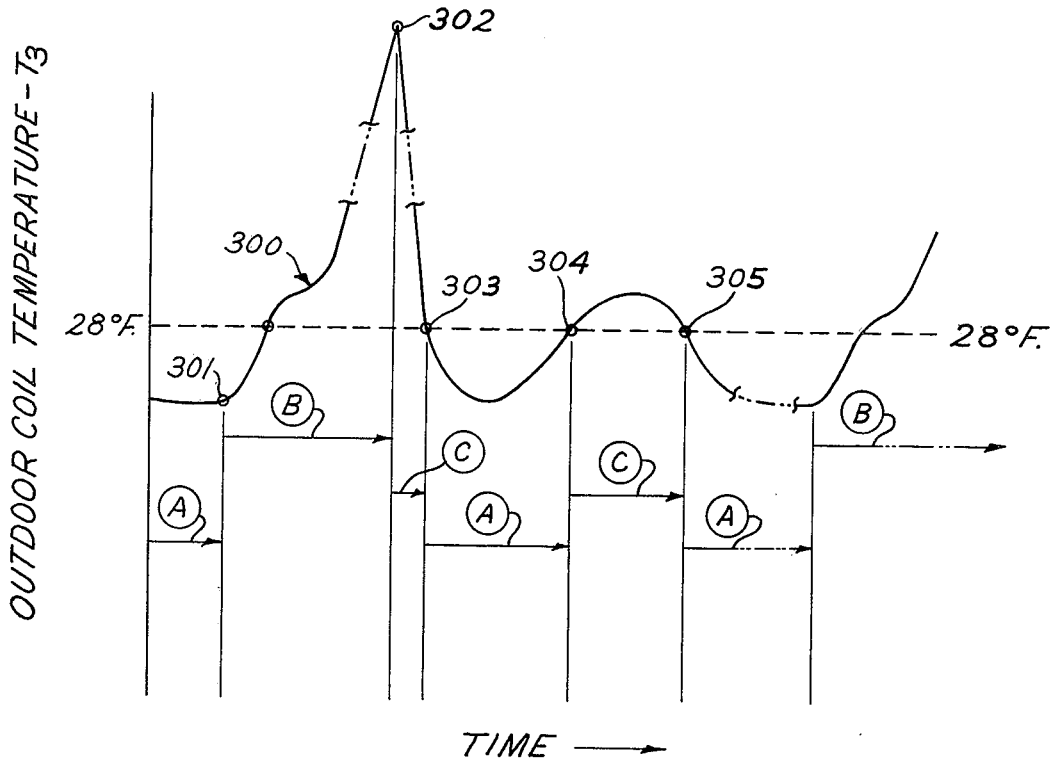
FIG. 6 is a graph of outdoor coil temperature versus time illustrating certain operating principles of the present invention.

Having provided for the minimum defrost lockout time interval to be effective at a given outdoor temperature level, further system efficiency can be achieved by providing for extending this lockout time interval so as to further delay initiation of the defrost cycle should actual conditions warrant it. This is accomplished in accordance with another important aspect of the invention by counting as elapsed time between defrost cycles only those periods of time during which the compressor is in the "on" or running condition and the temperature of a selected point on the outdoor coil is below a predetermined temperature such as 28° F. which is representative of the fact that the overall coil temperature is low enough to be capable of forming frost thereon. Referring to FIG. 6, there is shown a graph of time versus temperature of the outdoor coil 18 sensed by sensor $T_3$ at the coldest point on the coil in the heating mode, typically the bottom of the coil. In this graph, curve 300 represents the temperature sensed at the bottom of outdoor coil 18. At point 301, a previous defrost lockout time interval A has just been completed. At this time, a minimum time interval to be effective for the next successive defrost lockout time interval is determined by comparison of the outdoor temperature sensed by sensor $T_8$ (FIG. 1) with the selected time vs. temperature function of FIG. 2. This time interval is posted in clock means in controller 38. The heat pump then enters into a defrost cycle B causing the temperature of coil 18 to rise. At point 302, which may, for example, be a temperature of 50° F. as sensed by sensor $T_3$, the defrost cycle B is terminated and, during a short initial interval C, the heat pump reverts to the heating mode, causing the coil temperature to fall rapidly below the aforementioned predetermined coil temperature level of 28° F. The defrost lockout time interval A, therefore, first commences when the coil temperature drops below 28° F. at point 303 on curve 300 and the compressor is simultaneously in the "on" or running condition. Subsequently, if the coil temperature rises above 28° F., as shown between points 304 and 305, the corresponding time interval C is not counted towards the defrost lockout time interval even though the compressor may be continuing to run with the heat pump in the heating mode. The basis for this is that the coil itself is too warm during this time interval to cause continued frost build-up. In this way, too frequent initiation of the defrost cycle can be minimized by extending the actual defrost lockout time interval beyond the selected minimum lockout interval by an amount of time equal to cummulative time during which there is not a simultaneous occurrence of coil being below a predetermined temperature level and the compressor being in the "on" or running mode. It will be appreciated that the minimum defrost lockout time interval may alternatively be determined at any time prior to termination of the defrost cycle preceding the defrost lockout time interval being entered into.

Figure 4:
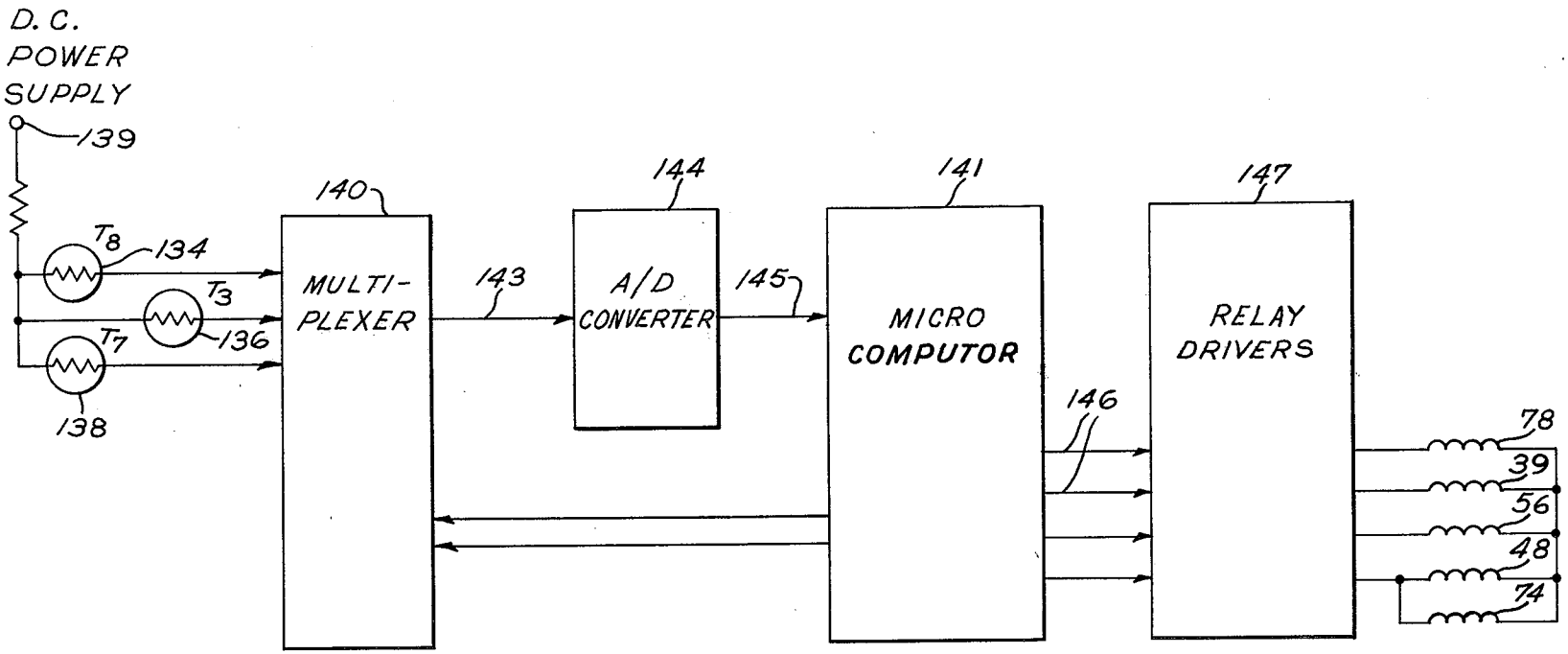
FIG. 4 shows a block diagram generally illustrating the system controller used to control the defrost function of the heat pump of FIG. 1.

Before considering the program flow chart of FIG. 3 from which a suitable microcomputer program may be developed for performance of the present invention, there will first be described with reference to FIGS. 4 and 5*a*, 5*b* a more detailed description of the system controller 38 illustrating one preferred embodiment of the present invention. In FIG. 4, there are shown three thermistor temperature sensors 134, 136 and 138 powered from a suitable d.c. source 139 and adapted to transmit an analog signal to a conventional multiplexer 140 representative of the outdoor ambient temperature $T_8$, the temperature $T_3$ of the cold end of the coil 18, and the indoor temperature $T_7$, respectively. The multiplexer 140 couples the signals representative of temperatures $T_3$, $T_7$ and $T_8$ in timed sequence along an input line 143 to a conventional analog-to-digital converter 144. Equivalent digital information, corresponding to the sequential analog information supplied along the line 143, is supplied by the converter 144 along a line 145 to a memory section of the microcomputer 141 to be stored until required according to the process of FIG. 3 to be described subsequently.

Figure 5A:
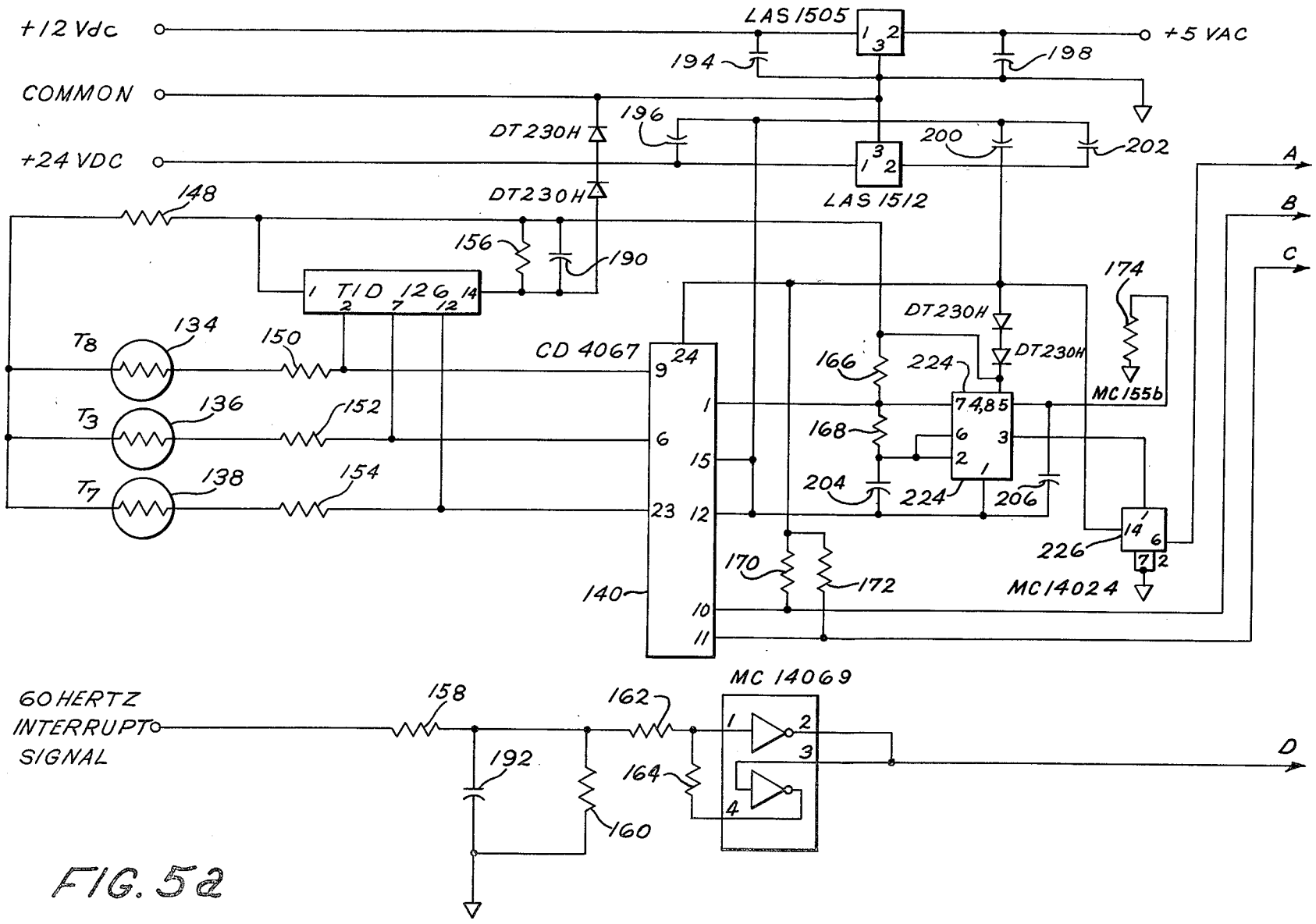
FIGS. 5*a*, 5*b* show a schematic wiring diagram of the system controller of the heat pump of FIG. 1 for execution of the defrost function.
Figure 5B:
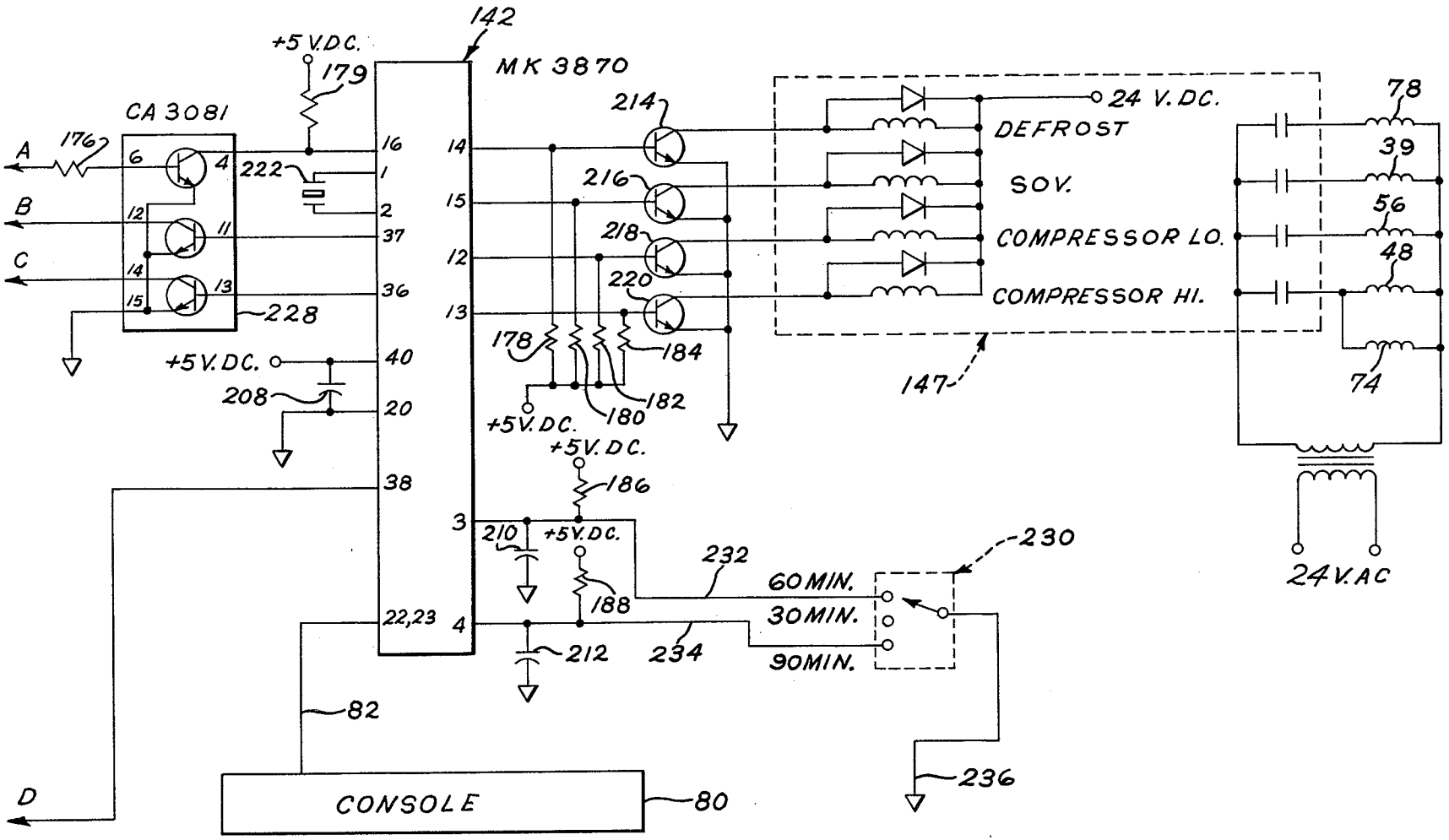

FIGS. 5*a*–5*b* illustrate in greater detail the controller 38 schematically shown in FIG. 4. Upon command from the microprocessor 142, the multiplexer 140 places the desired one of the thermistors 134, 136 or 138 in the circuit of an oscillator 224. Resistors 148 and 166 tend to linearize the otherwise highly non-linear resistance versus temperature characteristics of the thermistors 134, 136 and 138. Resistors 148 and 166, in combination with resistor 168 and capacitor 204, cause the oscillator 224 to oscillate at a frequency which is a function of the temperature of the particular thermistor being read through the multiplexer 140. A divide-by-sixteen flip flop 226 translates the signal generated by the oscillator 224 to a frequency range suitable for use by the microprocessor. Thus, the oscillator 224 operates at a relative high frequency which allows the capacitor 204 to be of reasonably small value.

The microprocessor 142 monitors the frequency of operation of the oscillator 224 through a transistor buffer 228. The microprocessor 142 executes a subroutine in monitoring the oscillator signal and counts the number of specific pre-established time increments occurring between the time the oscillator signal goes from high to low and back to high again during one waveform period, the resulting number being proportional to the period of the oscillator signal. The microprocessor 142 next executes a subroutine wherein a table in its Read Only Memory (ROM) is consulted to determine the temperature of the thermistor being read which corresponds to the number representing the period of the oscillator signal.

The microprocessor 142 also controls which of the thermistors 134, 136 and 138 is to be connected to the oscillator 224 through lines joining its terminals 36 and 37. These lines are buffered through certain of the transistors in the buffer 228 and control the multiplexer 140 at terminals 10 and 11 thereof. A crystal 222 is connected to the microprocessor 142 to form a crystal controlled oscillator for the purpose of generating a fixed, accurate short term timing signal for execution of the internal program. Accurate long term timing for keeping track of relatively long term events such as the maximum allowable defrost time and the like is obtained by way of a 60 Hertz interrupt signal supplied to the microprocessor 142 at the terminal 38.

Figure 2:
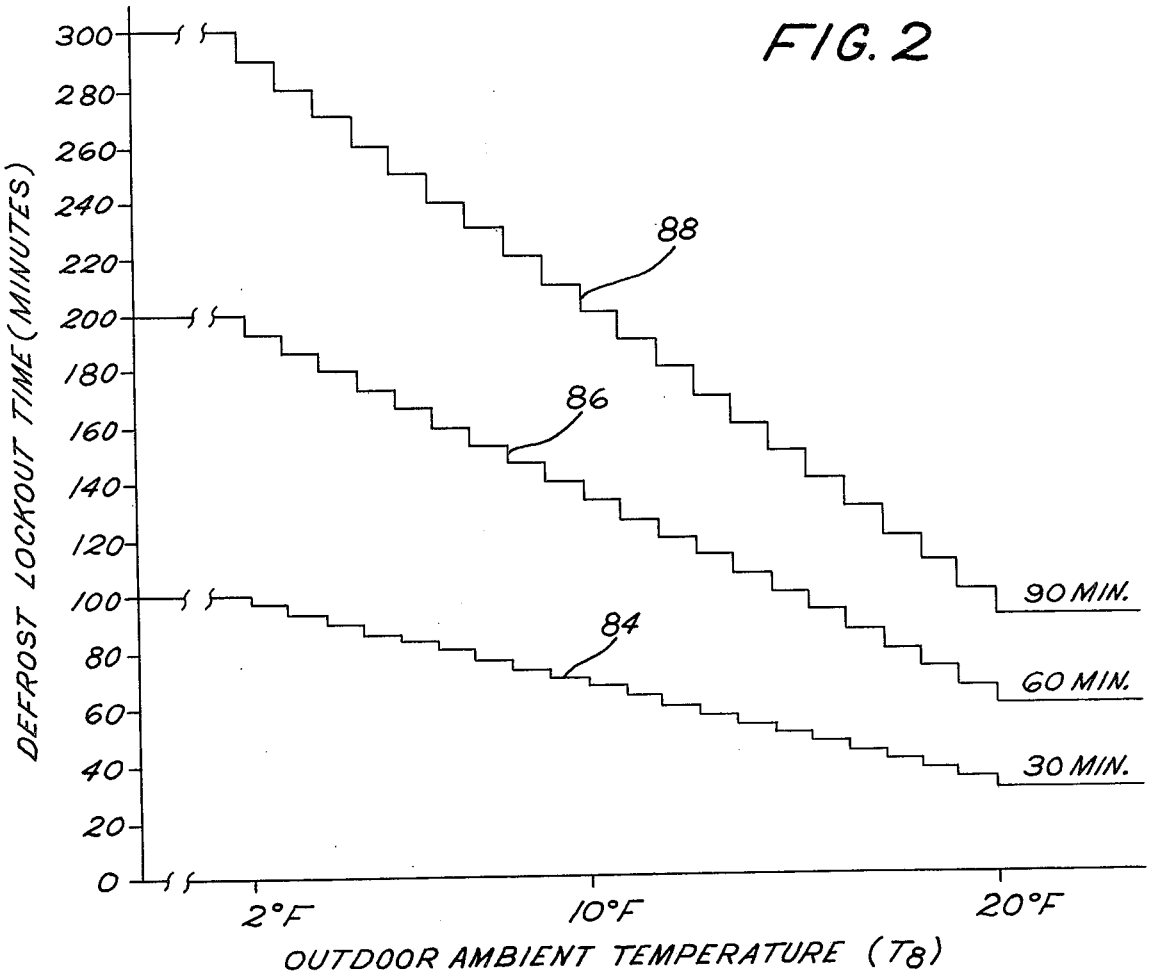
FIG. 2 shows a diagram of three separate step-wise linear functions of defrost inhibit time ("lockout") versus outdoor ambient temperature which may be selected for use by the system controller of the heat pump of FIG. 1 in defrosting operations.

As previously described, the data points corresponding to the three individually selectable time vs. temperature functions 84, 86, 88 of FIG. 2 are stored within memory in microcomputer 141. A defrost function select switch 230 connected to the microprocessor 142 as shown permits the installer of the heat pump to select which of the three defrost lockout time functions 84, 86 and 88 will be employed in the programmed process. Thus, to select one of the functions 84, 86, or 88, the switch 230 is positioned, as for example by the installer, to place either a line 232 or a line 234, respectively, at common 236. If both of the lines 232 and 234 are floating, as where the arm of the switch 230 is connected to the 30 minute terminal or where both of the lines 232 and 234 are open for some reason, the function 84 is selected. Similarly, should both of the lines 232 and 234 be connected to common 236, as where a short circuit has occurred, the function 84 will be automatically selected.

By way of example, and without intention of being limited thereto, there follows a description of component values actually employed in control apparatus actually constructed in accordance with the principles of the present invention.

TABLE

| FIGS. 5, 5a & 5b Components | Description |
|---|---|
| Resistor 148 | 3240 Ohm, ⅛ Watt |
| Resistor 150 | 270 Ohm, ¼ Watt |
| Resistor 152 | 270 Ohm, ¼ Watt |
| Resistor 154 | 270 Ohm, ¼ Watt |
| Resistor 156 | 680 Ohm, ½ Watt |
| Resistor 158 | 1000 Ohm, ¼ Watt |
| Resistor 160 | 1000 Ohm, ¼ Watt |
| Resistor 162 | 39K Ohm, ¼ Watt |
| Resistor 164 | 100K Ohm, ¼ Watt |
| Resistor 166 | 20K Ohm, ¼ Watt |
| Resistor 168 | 150 Ohm, ¼ Watt |
| Resistor 170 | 10K Ohm, ¼ Watt |
| Resistor 172 | 10K Ohm, ¼ Watt |
| Resistor 174 | 270K Ohm, ¼ Watt |
| Resistor 176 | 10K Ohm, ¼ Watt |
| Resistor 178 | 3.3K Ohm, ¼ Watt |
| Resistor 179 | 4.7K Ohm, ¼ Watt |
| Resistor 180 | 3.3K Ohm, ¼ Watt |
| Resistor 182 | 3.3K Ohm, ¼ Watt |
| Resistor 184 | 3.3K Ohm, ¼ Watt |
| Resistor 186 | 3.3K Ohm, ¼ Watt |
| Resistor 188 | 3.3K Ohm, ¼ Watt |
| Capacitor 190 | 4.7 mfd, 35 Volt |
| Capacitor 192 | 0.1 mfd, 100 Volt |
| Capacitor 194 | 6.8 mfd, 35 Volt |
| Capacitor 196 | 3.3 mfd, 75 Volt |
| Capacitor 198 | 33. mfd, 10 Volt |
| Capacitor 200 | 6.8 mfd, 35 Volt |
| Capacitor 202 | 0.1 mfd, 100 Volt |
| Capacitor 204 | 0.12 mfd, 200 Volt |
| Capacitor 206 | 0.01 mfd, 100 Volt |
| Capacitor 208 | 0.1 mfd, 100 Volt |
| Capacitor 210 | 0.1 mfd, 100 Volt |
| Capacitor 212 | 0.1 mfd, 100 Volt |
| Transistor 214 | GE GES6016 |
| Transistor 216 | GE GES6016 |
| Transistor 218 | GE GES6016 |
| Transistor 220 | GE GES6016 |
| Crystal 222 | 3.579545 MHZ |

Referring now to FIG. 3, there will now be described a program flow chart based on which those skilled in the art may readily program the microcomputer 141 for the operation of the defrost control apparatus of the controller 38. It will be assumed initially that the heat pump has just been placed in the heating mode as indicated at block 90. Instruction block 92 causes controller 38 to post an initial minimum defrost lockout time in memory (for example 20 minutes). Thereafter, inquiry block 94 is then entered to determine whether the indoor temperature at $T_7$ (FIG. 1) is below the room set point temperature which has been manually entered in the console 80 by the user. If the answer is YES, the compressor 10 is turned on at block 96 and the program thereafter resets controller 38 to a START condition after a time delay indicated by block 98. If the answer at the block 94 is NO, meaning that the indoor temperature at $T_7$ is equal to or greater than the room set point temperature in console 80, the program by-passes instruction block 96 and resets controller 38 directly to START after the time delay at block 98.

In either case, upon reaching the START condition, the program inquires at block 100 whether the console 80 is still set in the heat mode. If NO, the controller 38 is caused by instruction block 102 to switch the heat pump out of the heat mode and turns the compressor 10 off. If the system is in the heat mode, inquiry block 104 determines whether defrost is in process and, if not, inquiry block 106 determines whether the compressor 10 is running. Assuming the compressor is running, inquiry block 108 determines whether the temperature $T_3$ of the cold end of the outdoor coil 18 is below 28° F. If YES, inquiry block 110 then determines whether the posted defrost lockout time has expired and, if not, the defrost lockout time currently posted in memory by the controller 38 is decremented one time increment by instruction block 112. Had inquiry 108 determined that the $T_3$ temperature was at or above 28° F., the program would bypass around the clock decrement instruction 112 which would thereby have the effect of extending the defost lockout time by one time increment. Thereafter, inquiry is made in block 114 as to whether the indoor temperature at sensor $T_7$ is above the room set point temperature which was entered in the console 80 by the user. If YES, the compressor 10 is turned off at block 116 and the controller 38 is reset through block 98 to START. If NO, the controller 38 is reset directly through the block 98 to START.

Assuming that the defrost program has recycled enough times that inquiry 110 determines that the initial defrost lockout time of twenty minutes inserted by instruction 92 has expired, the instruction 118 posts a maximum preselected defrost cycle time interval (ten minutes) in memory and checks the setting of switch 230 to determine which function of FIG. 2 is to be operative. Instruction 122 then calculates and posts the minimum defrost lockout time interval to be effective as the next successive lockout time, following which instruction 124 initiates the next defrost cycle operation, all prior to resetting through the block 98 to the START position. In initiating the defrost operation, the controller 38 switches the valve 14 to place the pump in the cooling mode, and energizes the defrost relay 45 to disable the fan 12 (See FIG. 1).

If it had been determined at inquiry 106 that the compressor is not running, the program would then branch to block 94 to compare the indoor temperature $T_7$ with the console set point temperature and would proceed from that point as previously explained.

Assuming that, upon entering inquiry 104, it is determined that a defrost cycle is in process, the program branches off and inquires at block 126 whether the temperature $T_3$ on the cold end of the coil 18 is high enough to assure that the coil 18 has been fully defrosted, for example, greater than the aforementioned 50° F. If so, the defrost cycle is immediately terminated by instruction 128 (corresponding to point 302 of FIG. 6) and the controller 38 is reset to START. If $T_3$ still indicates a sensed temperature at or below 50° F., inquiry 130 determines whether the maximum defrost cycle as originally posted in memory as at the block 118, e.g. ten minutes, has expired. Assuming it has, then the assumption is that the temperature sensor at $T_3$ is or may be defective and the program moves to instruction 128 to terminate the defrosting operation. If the defrost cycle has not expired, the defrost cycle time currently registered in memory is decremented one time increment at block 132 and the controller resets to START. Of course, there are natural conditions, such as during freezing rain for example, where the defrost operation will normally proceed to the established 10 minute time limit. However, these conditions do not often occur and it is desirable to exit the defrost after a reasonable time since, as previously described, auxiliary heaters are normally employed which reduce system operating efficiency during defrost.

In accordance with the principles of the invention, it is sufficient to provide means for increasing the defrost lockout time as the outdoor ambient atmosphere to which the outdoor coil 18 is exposed decreases, at least through some range of temperatures that can be expected to cause substantial changes in the rate of frost build-up on the coil 18. While it is desirable to provide means for selecting different functions of defrost lockout time versus outdoor ambient temperature for use in different winter climates, it is by no means essential. The function select means illustrated in the present example is, therefore, an optional feature. It is also contemplated time vs. temperature functions other than the illustrated linear stepwise function may be employed, as for example, non-linear or exponential functions of defrost lockout time versus outdoor ambient temperature, the coordinate data points of which may also be stored in microprocessor memory for table look-up purposes in accordance with the program of FIG. 3.

While in accordance with the patent statutes, there has been described what at present is considered to be a preferred embodiment of the invention, it will be understood that various changes and modifications may be made by those skilled in the art without departing from the invention. It is, therefore, intended by the appended claims to cover all such changes and modifications as fall within the true spirit and scope of the invention.

What is claimed is:

1. In a heat pump having a reversible vapor compression refrigerant system including a refrigerant compressor, an indoor heat exchanger, an outdoor heat exchanger in thermal communication with outdoor atmosphere, and means for reversing refrigerant flow between said heat exchangers to switch the operation of the heat pump from an indoor heating mode to an outdoor heat exchanger defrost cycle mode, automatic defrost cycle control apparatus therefore comprising:

means for sensing the temperature of said outdoor atmosphere;

means for establishing a range of temperature related minimum defrost lockout time intervals during which operation of the defrost cycle is to be inhibited, said range of time intervals extending from a first interval effective at and above a first outdoor temperature to a second, longer interval effective at and below a second temperature level which is lower than said first temperature level;

means responsive to at least said temperature sensing means at least by the end of the defrost cycle to selecte one of said minimum time intervals to be effective as the next successive minimum defrost lockout time interval;

means for sensing the temperature of the refrigerant system at a predetermined point on the outdoor heat exchanger;

means responsive to said compressor and said refrigerant temperature sensing means and operative following the conclusion of a defrost cycle for clocking the time interval between defrost cycles only during the simultaneous occurrence of said compressor being in a running mode and the sensed refrigerant system temperature being below a predetermined temperature level;

and means for initiating a defrost cycle when the clocked time interval is equal to said selected minimum defrost lockout time interval.

2. The control apparatus of claim 1 in which said range of defrost lockout time intervals in an inverse time vs. temperature function.

3. The control apparatus of claim 2 in which said inverse function is approximately linear between said first and second temperature levels.

4. The control apparatus of claim 2 in which said inverse function is stepwise linear between said first and second temperature levels.

5. The control apparatus of claim 1 in which the selectable defrost lockout time intervals are selectively variable between a first outdoor temperature level of approximately 20° F. and a second outdoor temperature level of approximately 2° F. and are not selectively variable above the higher temperature level nor below the lower temperature level.

6. The control apparatus of claim 1 in which said predetermined coil temperature is approximately 28° F.

7. The control apparatus of claim 1 in which said predetermined point on the outdoor heat exchanger is selected to be normally the coldest point on the heat exchanger during the operation of the heat pump in the heating mode.

8. The control apparatus of claim 1 in which said defrost lockout time interval establishing means is adapted to establish a plurality of independently selectable ranges of lockout time intervals and means are provided for independently selecting one of said ranges, as desired, dependent on climatic conditions effective in the geographical location in which the heat pump is operating.

9. The control apparatus of claim 1 in which said next successive minimum defrost lockout time interval is determined at the conclusion of the immediately preceding defrost lockout time interval.

* * * * *